US008308872B2

(12) United States Patent
Burrows et al.

(10) Patent No.: US 8,308,872 B2
(45) Date of Patent: Nov. 13, 2012

(54) FEED TUBE ASSEMBLY FOR A DISHWASHER, AND ASSOCIATED APPARATUS AND METHOD

(75) Inventors: James L. Burrows, Winterville, NC (US); Gregory A. Meyer, Batesville, IN (US)

(73) Assignee: Electrolux Home Products, Inc., Cleveland, OH (US)

( * ) Notice: Subject to any disclaimer, the term of this patent is extended or adjusted under 35 U.S.C. 154(b) by 979 days.

(21) Appl. No.: 12/051,951

(22) Filed: Mar. 20, 2008

(65) Prior Publication Data

US 2008/0271764 A1 Nov. 6, 2008

Related U.S. Application Data

(60) Provisional application No. 60/916,218, filed on May 4, 2007.

(51) Int. Cl.
*B08B 3/00* (2006.01)

(52) U.S. Cl. ..... 134/56 D; 134/57 D

(58) Field of Classification Search ..... None
See application file for complete search history.

(56) References Cited

U.S. PATENT DOCUMENTS

| | | | | |
|---|---|---|---|---|
| 4,099,319 | A | 7/1978 | Vogel | |
| 4,815,606 | A * | 3/1989 | Airola | 206/532 |
| 4,820,351 | A | 4/1989 | Hambleton et al. | |
| 5,251,939 | A | 10/1993 | Jordan | |
| 5,942,169 | A | 8/1999 | Narazaki et al. | |
| 6,612,009 | B1 | 9/2003 | Laszczewski, Jr. et al. | |
| 2003/0006305 | A1 | 1/2003 | Hegeman et al. | |
| 2004/0183296 | A1 * | 9/2004 | Inoue et al. | 285/93 |
| 2005/0241680 | A1 | 11/2005 | Noh | |
| 2005/0284505 | A1 | 12/2005 | Bang | |
| 2006/0042657 | A1 * | 3/2006 | Welch | 134/10 |
| 2006/0060228 | A1 | 3/2006 | Yoon et al. | |
| 2006/0118147 | A1 | 6/2006 | Jeong et al. | |

FOREIGN PATENT DOCUMENTS

WO WO 2006/062305 A 6/2006

* cited by examiner

*Primary Examiner* — Michael Barr
*Assistant Examiner* — Jason Ko
(74) *Attorney, Agent, or Firm* — Alston & Bird LLP

(57) ABSTRACT

A spray arm feed tube assembly for a dishwasher is provided, comprising an elongate tubular member adapted to extend from a sump of the dishwasher, through an interface, and along a tub wall of a tub portion disposed outwardly of the sump. A banding member is operably engaged with the tubular member about the interface, wherein the banding member is adapted to cooperate with the tub portion and at least one separator member, about the interface, to prevent particulate matter from passing into the sump from the tub portion about the tubular member. An associated apparatus and method are also provided.

21 Claims, 6 Drawing Sheets

FEED TUBE ASSEMBLY FOR A DISHWASHER, AND ASSOCIATED APPARATUS AND METHOD

CROSS-REFERENCE TO RELATED APPLICATIONS

This application claims the benefit of U.S. Provisional Application No. 60/916,218, filed May 4, 2007, the contents of which are incorporated herein by reference.

BACKGROUND OF THE INVENTION

1. Field of the Invention

The present invention relates to dishwashers and, more particularly, to a feed tube assembly for a dishwasher, and associated apparatus and method.

2. Description of Related Art

A dishwasher typically includes a front-opening wash tub for receiving dishware to be washed therein. Associated with the tub is a sump defined by or otherwise disposed about the lower end of the tub, wherein the sump is configured to collect, under the influence of gravity, the dishwashing fluid circulated in the tub. Typically, the dishwashing fluid, such as water, is circulated from the sump by a circulation pump, and sprayed or otherwise dispensed through one or more spray arms operably arranged within and/or with respect to the tub. The fluid dispensed through the spray arm(s) is directed onto the dishware within the tub for removing food soils and other debris therefrom. After interacting with the dishware, the used dishwashing fluid typically drains under the influence of gravity toward the sump, wherein food soils and debris from the dishware are typically strained and/or filtered from the dishwashing fluid, within or before entering the sump and prior to recirculation through the spray arms.

The dishwashing fluid is typically directed from the circulation pump (in the sump) to the spray arm(s) disposed in the tub above the sump, via a feed tube extending therebetween. As such, the feed tube typically extends from the circulation pump in the sump, through an interface between the sump and the tub, and along a tub wall up to the level of the spray arm(s). The dishwashing fluid is then directed to the spray arm(s) via a valve and manifold system. However, the feed tube passing through the sump/tub interface may result in an alternate pathway for food soils and debris to enter the sump (i.e., about the feed tube) while possibly bypassing the straining/filtering provisions leading to or disposed within the sump of the dishwasher. Such an occurrence may be undesirable in the dishwasher, where effective filtering/straining of the dishwashing fluid may be an important factor in determining the quality of the dishwashing process and/or the water and energy consumption of the dishwasher. Further, ineffective straining/filtering of the dishwashing fluid may undesirably cause, for example, build-up of food soils within the hydraulic system of the dishwasher and/or clogging of the nozzles of the spray arm, particularly high pressure, low flow nozzles characterized by small nozzle bores.

Thus, there exists a need for a method and apparatus for effectively and efficiently minimizing or preventing food soils and debris (i.e., particles of greater than 20 thousandths of an inch) from bypassing the straining/filtering provisions of the dishwasher and entering the sump about the feed tube. Such a method and apparatus should desirably simplify tooling requirements for manufacturing such a feed tube assembly, as well as simplify the assembly process for the dishwasher.

BRIEF SUMMARY OF THE INVENTION

The above and other needs are met by the present invention which, in one embodiment, provides a spray arm feed tube assembly for a dishwasher. Such a feed tube assembly comprises an elongate tubular member adapted to extend longitudinally from a sump of the dishwasher, through an interface, and along a tub wall of a tub portion disposed outwardly of the sump. A banding member is operably engaged with the tubular member about the interface. The banding member is adapted to cooperate with the tub portion and at least one separator member, about the interface, to prevent particulate matter from passing into the sump from the tub portion about the tubular member.

Another aspect of the present invention provides a dishwasher comprising a tub portion configured to receive dishware therein. A sump portion is configured to be in association with the tub portion about a lower end thereof so as to form an interface therebetween, wherein the sump portion is configured to collect dishwashing fluid circulated in the tub portion. A separator member is configured to cooperate with the tub portion so as to substantially separate the tub portion and the sump portion. An elongate tubular member is configured to extend longitudinally from the sump portion, through the interface, and along a tub wall disposed outwardly of the sump portion. A banding member is operably engaged with the tubular member about the interface. The banding member is further configured to cooperate with at least one of the tub portion and at least one separator member, about the interface, to prevent particulate matter from passing into the sump from the tub portion about the tubular member.

Yet another aspect of the present invention comprises a method of a spray arm feed tube assembly for a dishwasher, wherein the spray arm feed tube assembly includes an elongate tubular member extending longitudinally from a sump of the dishwasher, through an interface, and along a tub wall of a tub portion disposed outwardly of the sump. Such a method comprises sealingly engaging a pliable substance with the tubular member about the interface so as to form a banding member, wherein the banding member cooperates with the tub portion and at least one separator member, about the interface, to prevent particulate matter from passing into the sump from the tub portion about the tubular member.

Embodiments of the present invention this provide significant advantages as disclosed herein in further detail.

BRIEF DESCRIPTION OF THE SEVERAL VIEWS OF THE DRAWING(S)

Having thus described the invention in general terms, reference will now be made to the accompanying drawings, which are not necessarily drawn to scale and which do not necessarily illustrate actual geometries, and wherein:

FIG. 1 schematically illustrates a feed tube assembly installed in a dishwasher, according to one embodiment of the present invention;

DETAILED DESCRIPTION OF THE INVENTION

The present invention now will be described more fully hereinafter with reference to the accompanying drawings, in which some, but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
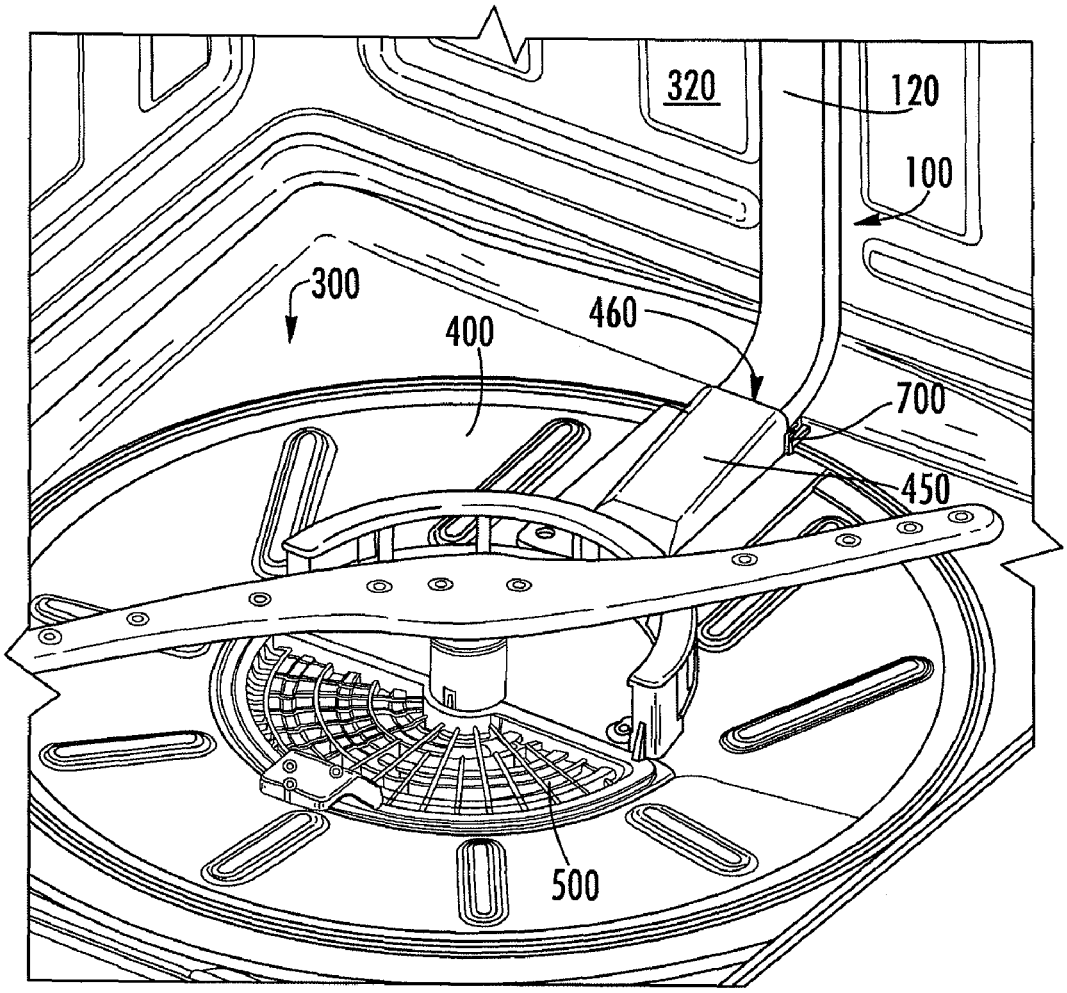
Figure 2:
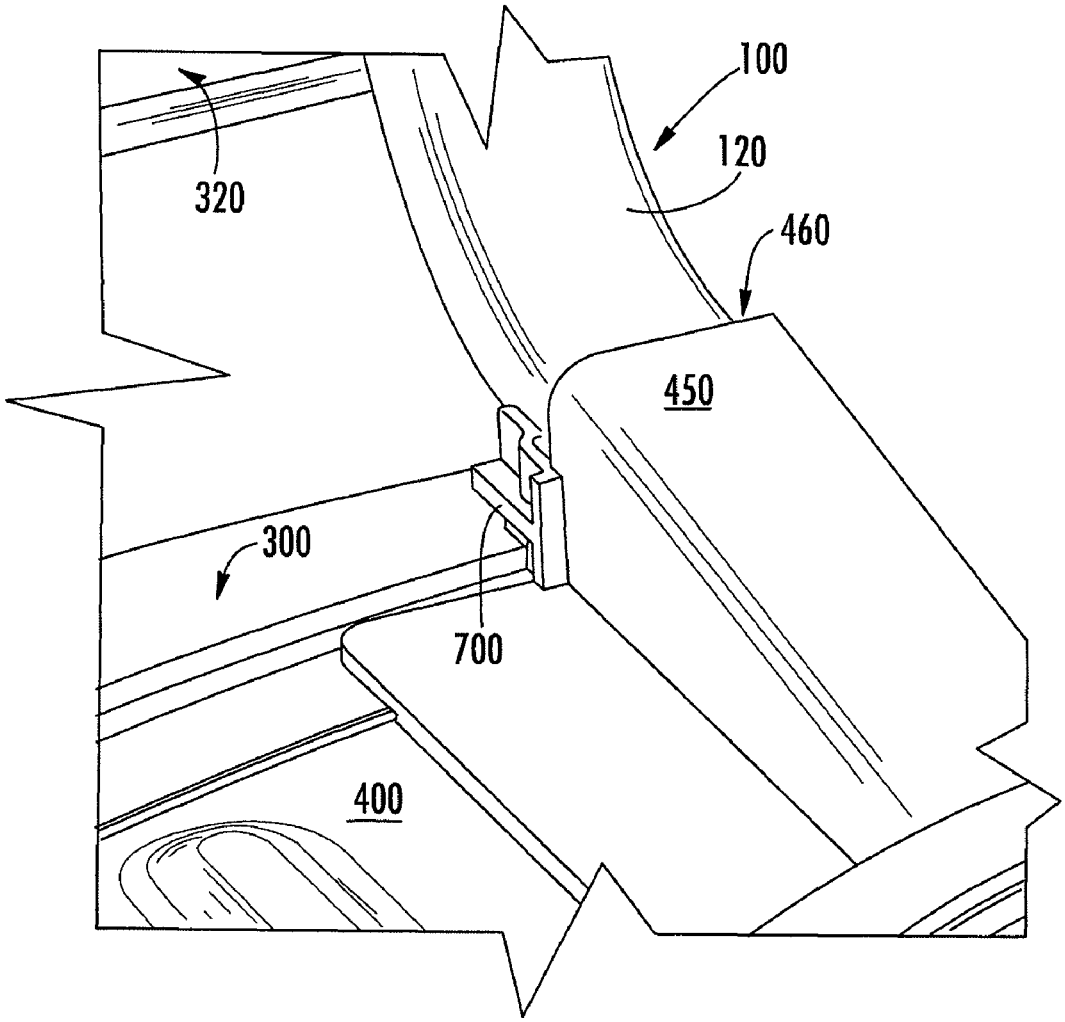
FIGS. 2 and 3 are magnified schematic perspective views of the feed tube assembly of FIG. 1 extending through a sump/tub interface of a dishwasher, according to one embodiment of the present invention.
Figure 3:
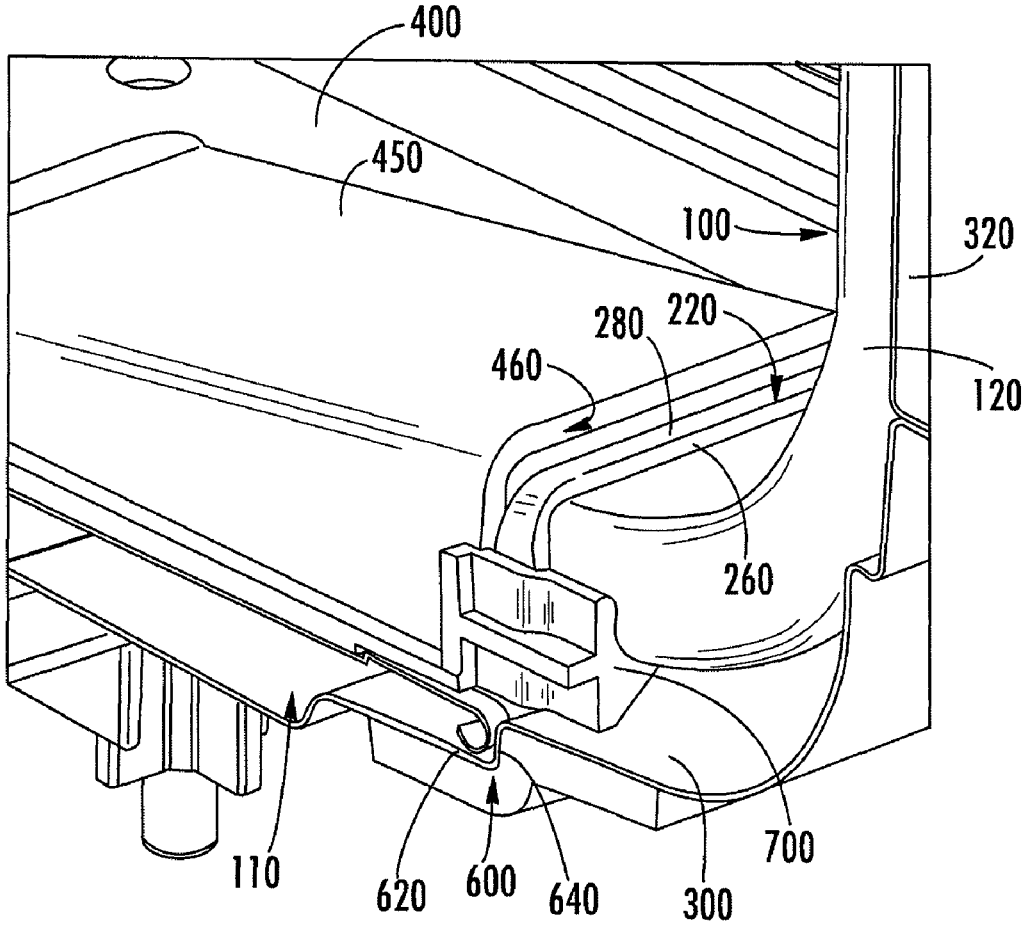
Figure 4:
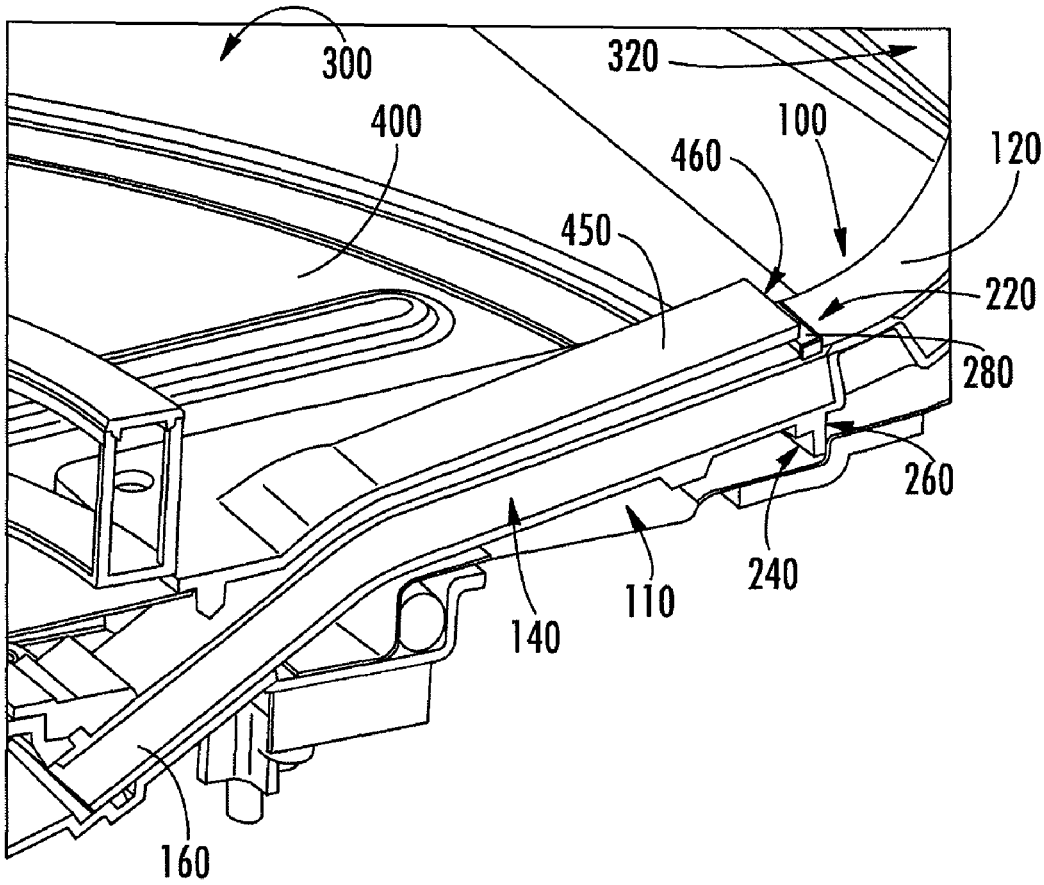
FIGS. 4 and 5 are magnified schematic perspective cross-sectional views of the feed tube assembly of FIG. 1 extending through a sump/tub interface of a dishwasher, according to one embodiment of the present invention.
Figure 5:
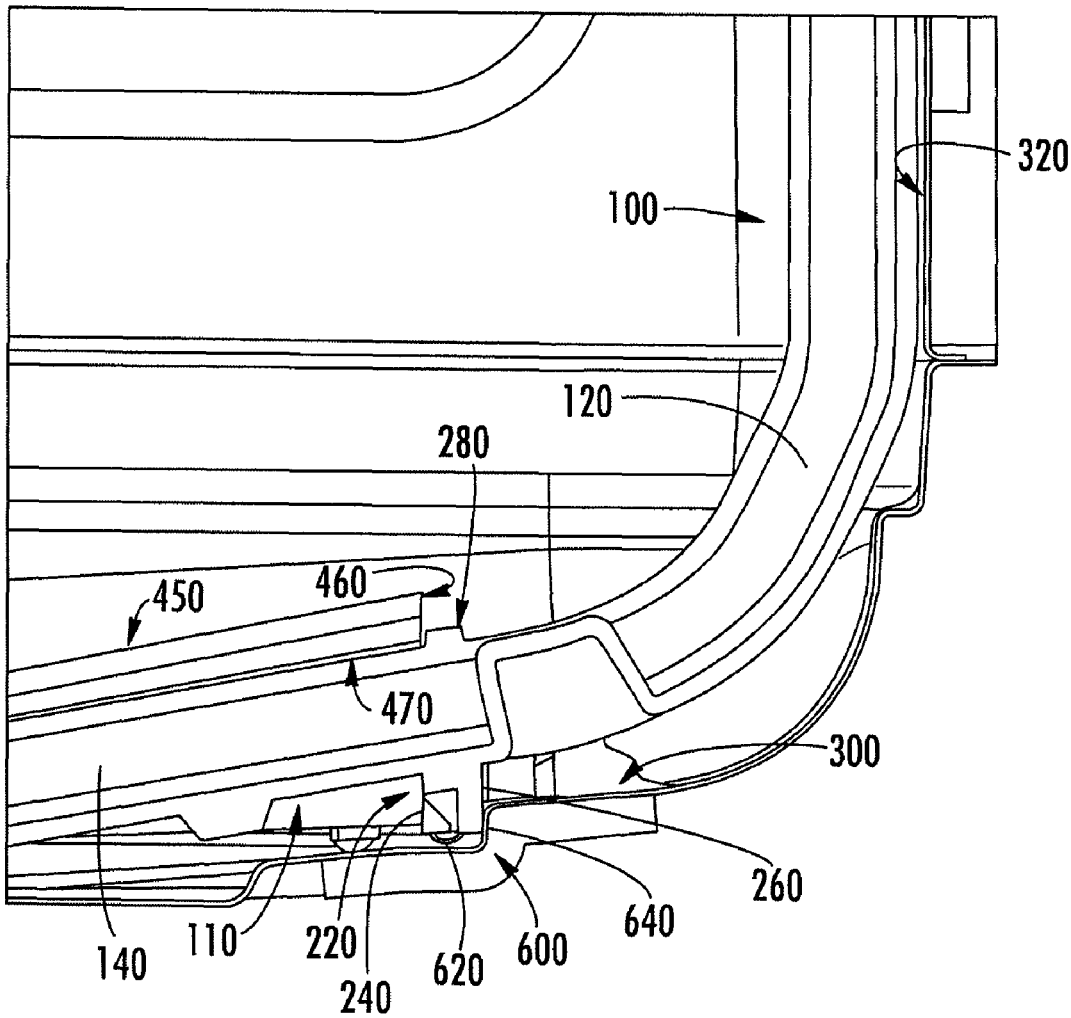
Figure 6:
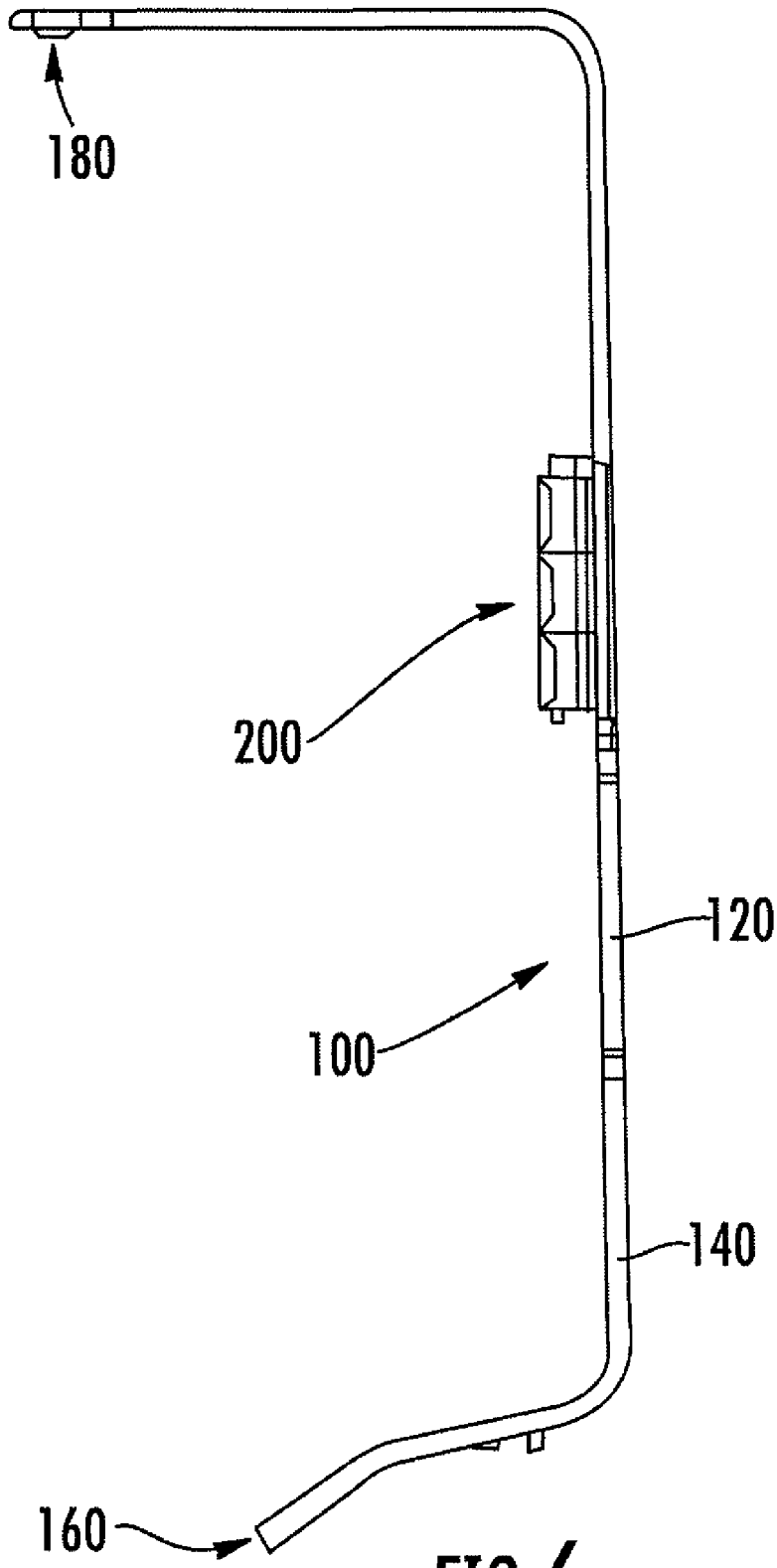
FIG. 6 is a schematic cross-sectional view of the feed tube assembly of FIG. 1.

FIGS. 1-6 schematically illustrate a spray arm feed tube assembly for a dishwasher according to one embodiment of the present invention, the feed tube assembly being generally indicated by the numeral 100. Such a feed tube assembly 100 includes an elongate tubular member 120 defining an interior channel 140, wherein the tubular member (or fluid delivery tube) 120 extends from sump end 160 (FIG. 6) to a tub end 180 (FIG. 6). The sump end 160 is configured to be in communication with a circulation pump (not shown), which may be disposed within the sump (or "sump portion") 110 (FIGS. 3 and 4) of the dishwasher, so as to receive the dishwashing fluid therefrom. From the sump end 160, the tubular member 120 extends out of the sump 110 and along the lower end 300 of the tub (or "tub portion") toward one of the walls (i.e., the rear wall 320) of the tub, wherein the tubular member 120 then transitions to run upward along the wall 320. The tubular member 120 may lead to, for example, a valve assembly 200 (FIG. 6) for a middle spray arm (not shown), to which the dishwashing fluid is directed. In some instances, the tubular member 120 may also be configured to extend further up the wall 320 before transitioning to run across the upper end (not shown) of the tub, where the tubular member 120 terminates at the tub end 180 thereof. The tub end 180 is configured to, for instance, further direct the dishwashing fluid to an upper spray arm (not shown), when the dishwasher implements such an upper spray arm.

In some instances, the dishwasher may include a separator member, such as a coarse filter/strainer assembly 400, for separating the tub from the sump 110, wherein the separator member is disposed or otherwise secured at the interface therebetween. The coarse filter/strainer assembly 400 may be, for example, circularly shaped in correspondence with the opening of the sump 110 (i.e., to cover the sump 110). However, in some cases, the coarse filter/strainer assembly 400 may only extend over a portion of the circular area, with the remainder being, for example, a solid cover portion 450. In those instances, the coarse filter/strainer portion and the remaining solid cover portion 450 may still be collectively referred to as the coarse filter/strainer assembly 400. As such, the circularly-shaped coarse filter/strainer assembly 400 could be sealed or otherwise secured to the sump/tub interface in various manners, such that food soils and debris would have to pass through at least the coarse filter/strainer portion before entering the sump 110, with no opportunity to bypass this provision. However, the coarse filter/strainer assembly 400 may be required, in some instances, to be modified in order to accommodate other components. For example, a "glass trap" 500 may also be accommodated by a radially inward portion of the coarse filter/strainer assembly 400, for trapping relatively large debris, such as pieces of glass. The tubular member 120 of the feed tube assembly 100 may also comprise a component which may necessitate modification of the coarse filter/strainer assembly 400, for example, about the perimeter of the coarse filter/strainer assembly 400 about the sump/tub interface. However, the tubular member 120 generally extends in an intersecting plane with the coarse filter/strainer assembly 400, and thus may not be readily sealed to either the coarse filter/strainer assembly 400 and/or the sump/tub about the interface.

As shown, the sump/tub, which may be, in some instances, of monolithic construction (i.e., stamped or molded as one piece), may include a recessed lip 600 about the interface for receiving the coarse filter/strainer assembly 400 such that the coarse filter/strainer assembly 400, when installed would appear to be flush with the lower end 300 of the tub. Forming the lip 600 would thus result in a lower, generally horizontal portion 620 toward the sump 110, as well as a generally vertical wall portion 640 disposed about the radially outward edge of the generally horizontal portion 620 and extending upwardly to the tub before transitioning to the generally horizontal lower end 300 of the tub. The tubular member 120 is configured to extend out of the sump 110 and, in some instances, may be configured to extend along an inclined path toward the tub wall (i.e., the rear vertical wall 320) through the sump/tub interface.

According to one aspect of the present invention, in order to seal the tubular member 120 with respect to the coarse filter/strainer assembly 400, as well as the sump/tub interface, the feed tube assembly 100 may further comprise a circumscribing (banding) member 220 sealingly engaged (i.e., as an "overmold") with the tubular member 120 about the sump/tub interface, and extending about the tubular member 120 so as to define a plane extending substantially perpendicularly to the longitudinal direction (i.e., the direction of fluid flow). In some instances, the tubular member 120 may be molded from a thermoplastic material such as, for example, a polypropylene material, and may optionally include a filler material such as, for example, a calcium carbonate, glass, talc, and/or any other suitable filler material. In such instances, the circumscribing member 220 may be comprised of, for example, a thermoplastic elastomer such as "Sanoprene™" or other suitable "soft touch" or pliable material. The circumscribing member 220, in one embodiment, is configured to form a chemical bond with the tubular member 120, so as to provide the sealing engagement therebetween. In such an embodiment, an appropriate bonding material such as, for example, a polypropylene/polyethylene material, a silicone-type bonding material, and/or any other suitable bonding material, may be disposed between the circumscribing member 220 and the tubular member 120, so as to provide the sealing engagement therebetween.

The circumscribing member 220 is applied to an external surface of the tubular member 120 wherein, in some instances, the tubular member 120 may define a recessed channel (not shown) for receiving the circumscribing member 220. Since the circumscribing member 220 extends about the tubular member 120, in a plane extending substantially perpendicularly to the longitudinal direction, the circumscribing member 220 defines a sump-side face 240 and a tub-side face 260, as well as an outer perimetric surface 280. As such, when the feed tube assembly 100 is installed in the dishwasher (i.e., secured to the tub wall 320 and/or the sump 110) so as to extend across the sump/tub interface, the tub-side face 260 may form a sealing engagement with the generally vertical wall portion 640 of the lip 600. In some instances, the outer perimetric surface 280 may also form a sealing engagement with the lower, generally horizontal portion 620 of the lip 600.

Once the feed tube assembly 100 is installed, the coarse filter/strainer assembly 400 is installed. In some instances, the solid cover portion 450 may be configured to follow the inclined path of the tubular member 120, whereby a covering surface thereof extending up to or over the circumscribing member 220. In such instances, the solid cover portion 450 may include an end wall 460 associated with the covering surface for forming a sealing engagement with the sump-side face 240 of the circumscribing member 220, or the covering surface 470 of the solid cover portion 450 may form a sealing engagement with the outer perimetric surface 280 of the circumscribing member 220. About the vertical sides of the tubular member 120, the solid cover portion 450 may be configured to sealingly engage the circumscribing member 220 so as to complete the sealing engagement with the coarse filter/strainer assembly 400. For example, the solid cover member 450 may include a clip assembly or snap feature components 700 engaged therewith and extending across the circumscribing member 220, along the vertical side walls of the tubular member 120, and which form a secured engagement (such as a "snap fit") one of the circumscribing member 220 and the tubular member 120 (i.e., to secure the solid cover portion 450 against vertically upward, horizontal, or rotational movement with respect to the circumscribing member 220 and the tubular member 120). In doing so, the snap feature components 700 may also form a sealing engagement with the circumscribing member 220 as well as facilitate a sealing engagement between the circumscribing member 220 and the solid cover portion 450. As such, a feed tube assembly 100 as disclosed herein in conjunction with embodiments of the present invention effectively and efficiently minimizes or prevents food soils and debris (i.e., particles of greater than 20 thousandths of an inch) from bypassing the coarse filter/strainer assembly 400 of the dishwasher and entering the sump 110 about the feed tube assembly 100.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A feed tube assembly for a dishwasher comprising a tub portion and a sump portion, wherein a lip portion for receiving at least one separator member defines a recess about an interface between the tub portion and the sump portion, the feed tube assembly comprising:

an elongate tubular member adapted to extend longitudinally from the sump portion, through the interface defined between the sump portion and the tub portion, and along a tub wall disposed outwardly of the sump portion; and a banding member operably engaged with the tubular member about the interface, the banding member being adapted to extend within the recess of the lip portion so as to sealingly engage the lip portion, about the interface, to prevent particulate matter from passing into the sump portion from the tub portion about the tubular member.

2. A feed tube assembly according to claim 1, wherein the banding member is configured to sealingly engage the tubular member and to extend around the tubular member so as to define a plane extending substantially perpendicular thereto, the banding member thereby being adapted to sealingly engage the tub portion so as to seal the interface between the tub portion and the sump portion.

3. A feed tube assembly according to claim 1, wherein the banding member comprises a thermoplastic elastomer material capable of sealingly engaging the tubular member.

4. A feed tube assembly according to claim 1, wherein the tubular member defines a recessed channel extending around the tubular member proximate to the interface, the channel being configured to receive the banding member.

5. A feed tube assembly of claim 1, wherein the banding member is adapted to extend downwardly within the recess of the lip portion so as to sealingly engage the lip portion.

6. A feed tube assembly of claim 1, wherein the banding member is independently formed of the tubular member and secured thereto so as to be in sealing engagement therewith.

7. A method of forming a feed tube assembly according to claim 1, said method comprising:

sealingly engaging a pliable substance with the tubular member about the interface so as to form the banding member.

8. A method according to claim 7, wherein sealingly engaging a pliable substance with the tubular member further comprises sealingly engaging a thermoplastic elastomer with the tubular member, the tubular member comprising a thermoplastic material, so as to form the banding member, with the banding member extending around the tubular member so as to define a plane extending substantially perpendicular thereto.

9. A method according to claim 7, wherein sealingly engaging a pliable substance with the tubular member further comprises sealingly engaging a pliable substance within a channel defined by and extending around the tubular member about the interface.

10. A dishwasher comprising:

a tub portion configured to receive dishware therein;

a sump portion disposed about a lower end of the tub portion so as to form an interface therebetween, the sump portion being configured to collect dishwashing fluid circulated in the tub portion;

a separator member received by a lip portion defining a recess about the interface, the separator member configured to cooperate with the tub portion so as to substantially separate the tub portion and the sump portion;

an elongate tubular member configured to extend longitudinally from the sump portion, through the interface, and along a tub wall disposed outwardly of the sump portion; and a banding member operably engaged with the tubular member about the interface, the banding member being configured to extend within the recess of the lip portion so as to sealingly engage the lip portion, about the interface, to prevent particulate matter from passing into the sump portion from the tub portion about the tubular member.

11. A dishwasher according to claim 10, wherein the banding member is configured to sealingly engage the tubular member and to extend around the tubular member so as to define a plane extending substantially perpendicular thereto, the banding member thereby being configured to sealingly engage the tub portion so as to seal the interface between the tub portion and the sump portion.

12. A dishwasher according to claim 10, wherein the banding member comprises a thermoplastic elastomer material configured to sealingly engage the tubular member.

13. A dishwasher according to claim 10, wherein the tubular member defines a recessed channel extending around the tubular member proximate to the interface, the channel being configured to receive the banding member.

14. A dishwasher according to claim 10, wherein the banding member further comprises a tub-side surface configured to sealingly engage a substantially vertical portion of the lip portion.

15. A dishwasher according to claim 10, wherein the banding member further comprises an outer perimetric surface configured to sealingly engage a substantially horizontal portion of the lip portion.

16. A dishwasher according to claim 10, wherein the separator member comprises a filter assembly configured to be secured about the interface and having a filter plane associated therewith, the tubular member being configured to extend from the sump portion to the tub portion through the filter assembly.

17. A dishwasher according to claim 10, further comprising a cover member operably engaged between the separator member and the tubular member about the interface and having a covering surface configured to at least partially extend over the tubular member, the cover member having an end wall associated with the covering surface, the end wall being configured to sealingly engage a sump-side face of the banding member.

18. A dishwasher according to claim 17, wherein the cover member further comprises a clip assembly configured to form a snap fit engagement with at least one of the banding member and the tubular member so as to secure the cover member between the separator member and the tubular member.

19. A dishwasher according to claim 10, wherein the sump portion comprises an opening, the interface extending about the periphery of the opening, and wherein the separator extends partially over the opening to partially separate the sump portion from the tub portion.

20. A dishwasher according to claim 19, further comprising a cover member engaged between the separator member and the tubular member about the interface and configured to extend at least partially over the tubular member and the opening of the sump portion, the cover member further configured to sealingly engage with the banding member such that the cover member and separator cooperate to completely separate the sump portion from the tub portion.

21. A feed tube assembly for a dishwasher comprising a tub portion and a sump portion, wherein a lip portion defined by one of the tub portion and the sump portion defines a recess about an interface therebetween, the feed tube assembly comprising:

an elongate tubular member adapted to extend longitudinally from a sump portion of the dishwasher, through an interface defined between the sump portion and the tub portion, and along a tub wall disposed outwardly of the sump portion; and a banding member independently formed of the tubular member and secured thereto about the interface, the banding member being adapted to extend within the recess of the lip portion, the banding member comprising a thermoplastic elastomer material configured to sealingly engage with the tub portion, about the interface, to prevent particulate matter from passing into the sump portion from the tub portion about the tubular member.

* * * * *